US005530198A

United States Patent [19]

Ishii

[11] Patent Number: 5,530,198

[45] Date of Patent: Jun. 25, 1996

[54] PIANO-LIKE KEYBOARD MUSICAL INSTRUMENT FOR AUTOMATICALLY PLAYING MUSIC THROUGH FEEDBACK CONTROL WITH KEY ACCELERATION AND KEY VELOCITY

[75] Inventor: Jun Ishii, Shizuoka, Japan

[73] Assignee: Yamaha Corporation, Japan

[21] Appl. No.: 352,543

[22] Filed: Dec. 9, 1994

[30] Foreign Application Priority Data

Dec. 10, 1993 [JP] Japan ..... 5-341658
Nov. 7, 1994 [JP] Japan ..... 6-272282

[51] Int. Cl.[6] ..... G10F 1/02
[52] U.S. Cl. ..... 84/21; 84/22
[58] Field of Search ..... 84/2, 20, 21, 23, 84/626, 462

[56] References Cited

U.S. PATENT DOCUMENTS 4,135,428 1/1979 Cambell ..... 84/462 X
4,593,592 6/1986 Stahnke ..... 84/21
4,913,026 4/1990 Kaneko et al. ..... 84/21

FOREIGN PATENT DOCUMENTS 5-127667 5/1993 Japan .

*Primary Examiner*—Patrick J. Stanzione
*Attorney, Agent, or Firm*—Graham & James

[57] ABSTRACT

An automatic player piano is implemented by a combination of an acoustic piano and an automatic playing system, and a velocity feedback loop and an acceleration feedback loop control solenoid-operated key actuator units for reproducing a performance so that the acceleration feedback loop cancels the undesirable increment of the resistances of the solenoid coils and aged deterioration.

9 Claims, 14 Drawing Sheets

PIANO-LIKE KEYBOARD MUSICAL INSTRUMENT FOR AUTOMATICALLY PLAYING MUSIC THROUGH FEEDBACK CONTROL WITH KEY ACCELERATION AND KEY VELOCITY

FIELD OF THE INVENTION

This invention relates to a piano-like keyboard musical instrument and, more particularly, to a piano-like keyboard musical instrument equipped with solenoid-operated actuators for reproducing a music without fingering on the keyboard.

DESCRIPTION OF THE RELATED ART

Various models of the automatic player piano are presently available. The automatic player piano reproduces a performance in response to a series of digital music data codes indicative of a music by controlling solenoid-operated actuator units provided beneath a keyboard. FIG. 1 illustrates a typical example of the automatic player piano, and largely comprises an acoustic piano 1 and an automatic playing system 2. The acoustic piano 1 is equipped with a keyboard 1*a*, and the keyboard 1*a* is implemented by black and white keys 1*b* and 1*c* selectively depressed by a player.

The acoustic piano 1 further comprises key action mechanisms 1*d* functionally connected to the black and white keys 1*b* and 1*c*, respectively, hammer assemblies 1*e* driven for rotation by the key action mechanisms 1*d*, sets of strings 1*f* struck by the hammer assemblies 1*e* for vibrations and damper mechanisms 1*g* for damping the vibrations. When a player depresses one of the black and white keys 1*b* and 1*c*, the key 1*b*/1*c* rotates in the clockwise direction, and actuates the associated key action mechanism 1*d*. The key action mechanism 1*d* causes the damper mechanism 1*g* to leave the set of strings 1*f*, and the set of strings 1*f* is allowed to vibrate. The key action mechanism 1*d* slowly rotates the associated hammer assembly 1*e* toward the set of strings 1*f*, and escapes from the hammer assembly 1*e*. Then, the hammer assembly 1*e* rushes toward the set of strings 1*f*, and rebounds thereon. The set of strings 1*f* vibrates for generating a tone, and the key action mechanism 1*d*, the hammer assembly 1*e* and the damper mechanism 1*g* return to respective hole positions shown in FIG. 1. The damper mechanism 1*g* comes into contact with the set of strings 1*f*, and takes up the vibrations.

The automatic playing system 2 comprises a plurality of key sensors 2*a* for monitoring the motions of the black and white keys 1*b* and 1*c*, a controller 2*b* for producing a series of music data codes indicative of the key motions and a plurality of solenoid-operated actuator units 2*c* provided under the black and white keys 1*b* and 1*c* and responsive to driving signals DR1 supplied from the controller 2*b*. The key sensors 2*a* are respectively associated with the black and white keys 1*b* and 1*c*, and each key sensor 2*a* generates a key position signal KP1 indicative of a current key position between a rest position and an end position.

As shown in FIG. 2 of the drawings, the controller 2*b* comprises a micro-processor 2*d* accompanied with a program memory 2*e* and a working memory 2*f*, an input data buffer 2*g* for the key position signals KP1, a waveform generator 2*h*, driver units 2*i* and a shared bus system 2*j* for an address code and a data code transferred between the component units 2*d*, 2*e*, 2*f*, 2*g* and 2*h*.

While a player is recording a performance on the keyboard 1*a*, the microprocessor 2*d* periodically fetches the key position signals KP1, and produces a series of musical data codes each indicative of the depressed/released key and a key velocity calculated from the variation of the current key position. Upon completion of the performance, a series of musical data codes is stored in the working memory 2*f*, and is indicative of the performed music.

If the player requests the controller 2*b* to reproduce the performed music, the microprocessor sequentially fetches the stored music data codes, and transfers individual music data codes to the waveform generator 2*h*. The waveform generator 2*h* is responsive to each of the music data codes, and shapes a waveform WF1 indicative of variation of a target position for the associated solenoid-operated actuator unit 2*c*. The waveform generator 2*h* generates a waveform signal DP1 carrying the waveform WF1, and supplies the waveform signal DP1 to one of the driver units 2*i* associated with the depressed/released key 1*b*/1*c*. The driver unit 2*i* varies the amount of current of the driving signal DR1 in proportion to the waveform WF1, and the solenoid-operated actuator unit 2*c* projects the plunger thereof. The leading end of the plunger is proportional to the amount of current of the driving signal DR1, and the rotates the associated key 1*b*/1*c* as if the player depresses it. Thus, the controller 2*b* controls the solenoid-operated actuator units 2*c*, and the automatic playing system 2 reproduced the performed music.

As described hereinbefore, the prior art automatic player piano reproduces a music through the feed-forward control, and encounters following problems.

First, while the automatic playing system is reproducing a music, one of the black and white keys 1*b* and 1*c* may be repeatedly moved by the associated solenoid-operated actuator unit 2*i*, and the solenoid coil of the actuator unit 2*i* increases the resistance due to heat generation. If the resistance is increased, the solenoid-operated actuator unit 2*i* decreases the thrust, and the hammer assembly 1*e* strikes the set of strings 1*f* softer than the impact in the original performance.

Second, the waveform generator 2*h* does not take aged deterioration and dispersion of the machine work into account, and generates the waveform WF1 on the assumption that the acoustic piano is ideal. For this reason, if one of the key action mechanisms 1*d* increases friction, the solenoid-operated actuator unit 2*i* can not actuate the key action mechanism 1*d*, and the automatic playing system 2 continues the performance without the tone. This problem is serious when the automatic playing system 2 reproduces a pianissimo tone.

If the waveform generator 2*h* stores correction factors indicative of the dispersion of the key action mechanisms 1*d*, the second problem may be solved. However, the correction factors should be periodically updated, and a large memory unit is required for storing the correction factors. This results in complex arrangement of the waveform generator 2*h* and increase of the production cost.

The above described problems are inherent in the feed-forward control, and Japanese Patent Publication of Unexamined Application No. 3-229299 discloses a pedal controlling system which is free from the problems inherent in the feed-forward control.

FIG. 3 illustrates the pedal controlling system associated with a pedal system incorporated in the automatic player piano disclosed in the above Japanese Patent Publication of Unexamined Application. Although the pedal control is different to the key control, a problem inherent in the prior art pedal control is also encountered in a key control system designed on the same principle. For this reason, the prior art pedal controlling system is described hereinbefore.

Pieces of normalized position data X1 is stored in a floppy disk 10, and are indicative of the variation of actual pedal position in an original performance. The actual pedal position is changed between first to sixteenth grades, and each piece of normalized position data X1 is indicative of one of the sixteen grades.

The pieces of normalized position data X1 is sequentially read out from the floppy disk 10, and is supplied to an interpolation unit 11. The interpolation unit 11 interpolates sub-grades in the sixteen grades, and increases the total grades from sixteen to a hundred and twenty-eight. Each of the pieces of normalized position data X1 indicative of one of the sixteen grades is changed to a piece of normalized position data X1' indicative of one of a hundred and twenty-eight grades. The pieces of normalized position data X1' are supplied to an inverse normalization table 12, and are restored to pieces of position data Xi containing a deviation due to the dispersion of piano characteristics. The pieces of restored position data Xi are indicative of a target trajectory consisting of target positions.

The pieces of restored position data Xi are supplied in parallel to a position-to-PWM data converting table 13, a velocity calculator 14 and an acceleration calculator 15.

The position-to-PWM converting table 13 generates control codes PWMs for a PWM (Pulse Width Modulation) control. The velocity calculator 14 differentiates the restored position data Xi, and produces pieces of target velocity data Xi' indicative of variation of a target velocity. On the other hand, the acceleration calculator 15 differentiates the restored position data Xi twice, and produces pieces of target acceleration data Xi" indicative of variation of target acceleration.

The pieces of target velocity data Xi' are supplied to a multiplier 16, and are multiplied by a factor K1 for producing control codes PWM1. Similarly, the pieces of target acceleration data Xi" are supplied to a multiplier 17, and are multiplied by a factor K2 for producing control codes PWM2.

A solenoid-operated actuator unit 18 is provided for the pedal (not shown), and moves the pedal instead of a player. The solenoid coil **18*a* generates electro-magnetic force, and the magnitude of the electro-magnetic force is depending upon a pulse width of a driving signal DR2. The electro-magnetic force causes the plunger 18*b* to project from the solenoid coil 18*a*. A pedal sensor 19 monitors the plunger 18*b*, and generates a voltage signal PV1 indicative of an actual position of the plunger 18*b*. The voltage signal PV1 is supplied to an analog-to-digital converter 20**, and is converted into a digital position signal indicative of pieces of actual position data Xa.

The pieces of actual position data Xa are supplied in parallel to a velocity calculator 21 and an acceleration calculator 22. The velocity calculator 21 differentiates the actual position data Xa for producing pieces of actual velocity data Xa', and the acceleration calculator 22 differentiates the actual position data Xa twice for producing pieces of actual acceleration data Xa".

The pieces of restored position data Xi and the pieces of actual position data Xa are supplied to a subtracter 23, and the subtracter 23 produces pieces of deviation data dX indicative of a deviation between the target positions and the actual positions.

Similarly, the pieces of target velocity data Xi' and the pieces of actual velocity data Xa' are supplied to a subtracter 24, and the subtracter 24 produces pieces of deviation data dx' indicative of a deviation between the target velocity and the actual velocity. The pieces of target acceleration data Xi" and the pieces of actual acceleration data Xa" are supplied to a subtracter 25, and the subtracter 25 produces pieces of deviation data dX" indicative of a deviation between the target acceleration and the actual acceleration.

The pieces of deviation data dX, the pieces of deviation data dX' and the pieces of deviation data dX" are supplied from the subtracters 23, 24 and 25 to multipliers 26, 27 and 28, respectively. The multipliers 26, 27 and 28 multiply the pieces of deviation data dX, the pieces of deviation data dX' and the pieces of deviation data dX" by respective factors K3, K4 and K5, and produce control codes PWM3, PWM4 and PWM5, respectively.

The position-to-PWM converting table 13, the multipliers 16 and 17 and the multipliers 26 to 28 supply the control codes PWMs, PWM1–PWM2 and PWM3–PWM5 to a calculator 29, and the calculator 29 finally determines a PWM control signal PWM. The PWM control signal PWM is supplied to a PWM controller 30, and the PWM controller 30 generates the driving signal DR2.

In this instance, the control codes PWMs, PWM1 and PWM2 are used in a feed-forward control on the position, the velocity and the acceleration, and the other control codes PWM3 to PWM5 are used for a compensation through the feed-back control on the position, the velocity and the acceleration.

The prior art pedal controlling system shown in FIG. 3 is equivalent to a block sequence shown in FIG. 4, and "M" is the transfer function of a physical model for the pedal. The block sequence shown in FIG. 4 is sequentially changed through those shown in FIGS. 5, 6, 7, 8, 9 and 10, and the transfer function shown in FIG. 11 is finally obtained.

However, the prior art pedal controlling system encounters following problems. First, the control schema is so complex, and the pedal controlling system has a large number of parameters . This means that the pedal controlling system is hardly optimized. For example, "s" of the denominator of the transfer function is indicative of a damping coefficient, and is conducive to a stability of the pedal controlling system. The damping coefficient is regulable by changing the velocity feedback coefficient K4. However, if the velocity feedback coefficient K4 is changed, the change of the velocity feedback coefficient K4 affects the term "s" of the numerator indicative of the feed-forward control. Thus, the parameters are mutually affected, and the optimization is difficult.

Another problem inherent in the prior art pedal controlling system is that a secular change in the pedal mechanism affects the control. This is because of the fact that the feed-back control is auxiliary in the pedal controlling system. In other words, the feed-forward control mainly actuates the pedal mechanism on the assumption that the mechanical characteristics of the pedal mechanism are known and unchanged.

Therefore, if a solenoid-operated actuator unit is controlled mainly by a feed-forward sequence and auxiliary by a feed-back loop, the key control system may encounters the above described problems inherent in the prior art pedal control system.

SUMMARY OF THE INVENTION

It is therefore an important object of the present invention to provide a piano-like keyboard musical instrument which has an automatic playing system easily optimized and modifiable so as to follow up a secular change.

To accomplish the object, the present invention proposes to correct velocity deviation with a key acceleration.

In accordance with the present invention, there is provided a keyboard musical instrument comprising: an acoustic piano having a keyboard implemented by a plurality of keys selectively rotated by a player, a plurality of sets of strings respectively assigned notes of a scale identical with the plurality of keys, a plurality of hammer assemblies respectively associated with the plurality of sets of strings and rotated for striking the associated sets of strings, and a plurality of key action mechanisms functionally connected to the plurality of keys, respectively, and rotating the hammer assemblies when the associated keys are rotated; and an automatic playing system having a plurality of actuator units respectively associated with the plurality of keys, and selectively rotating the associated keys in the presence of driving signals, a plurality of monitoring means respectively associated with the plurality of keys, and determining actual key velocities of the associated keys when the associated keys are rotated, a target key velocity supplying means outputting target key velocities for keys selected from the plurality of keys to be rotated, a velocity feedback loop functionally connected to the target key velocity supplying means and the plurality of monitoring means and operative to respectively compare the target key velocities with the actual key velocities of the keys for generating a plurality of velocity error signals, and an acceleration feedback loop functionally connected to the velocity feedback loop and the plurality of monitoring means and determining accelerations of the keys rotated by the associated actuator units, the acceleration feedback loop being operative to varies the velocity error signals with the accelerations for generating the driving signals.

BRIEF DESCRIPTION OF THE DRAWINGS

The features and advantages of the keyboard-like keyboard musical instrument according to the present invention will be more clearly understood from the following description taken in conjunction with the accompanying drawings in which.

DESCRIPTION OF THE PREFERRED EMBODIMENT

Figure 1:
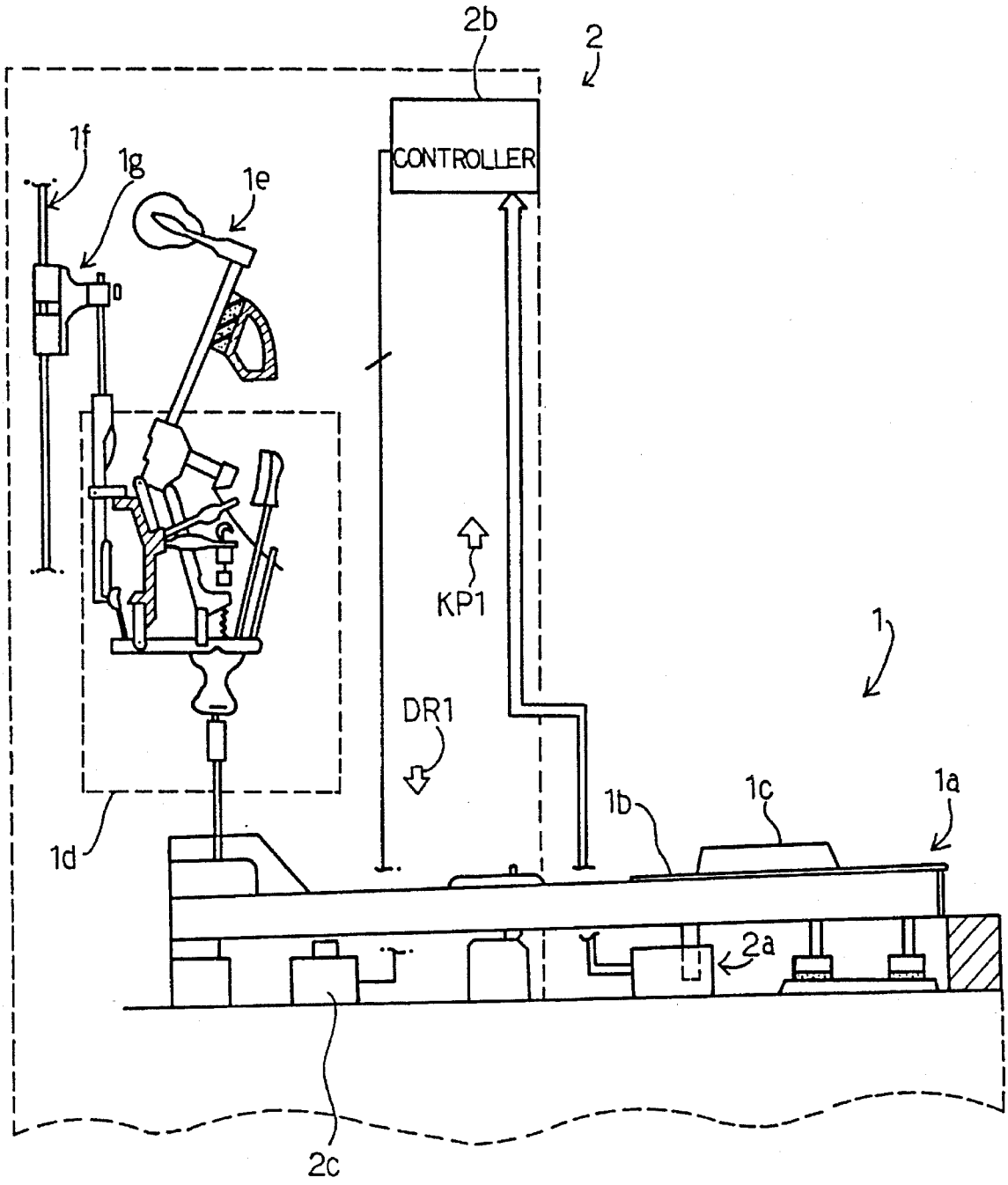
Fig ·1 PRIOR ART
FIG. 1 is a partially cut-away side view showing the prior art automatic player piano.
Figure 2:
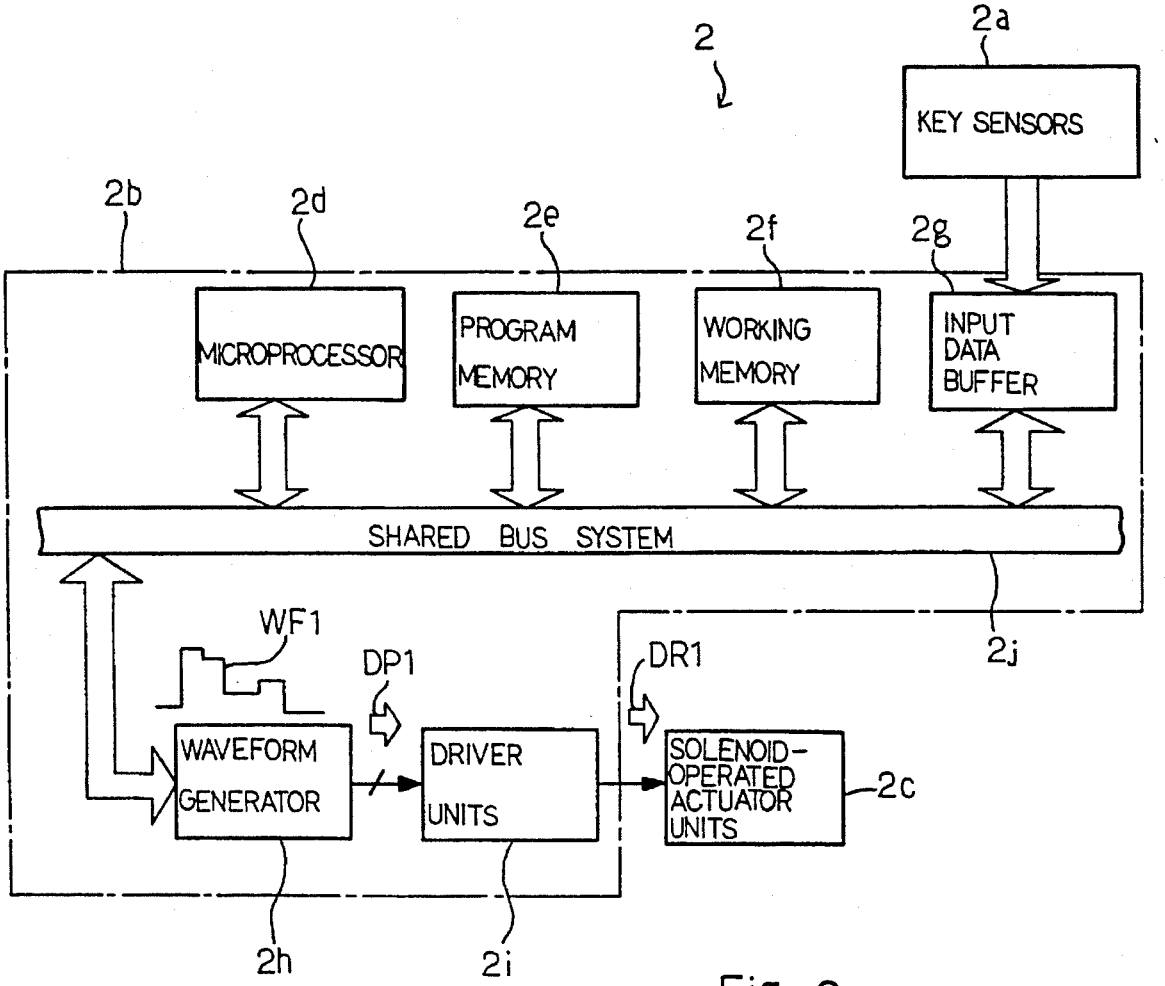
Fig. 2 PRIOR ART
FIG. 2 is a block diagram showing the arrangement of the controller incorporated in the prior art automatic player piano.
Figure 3:
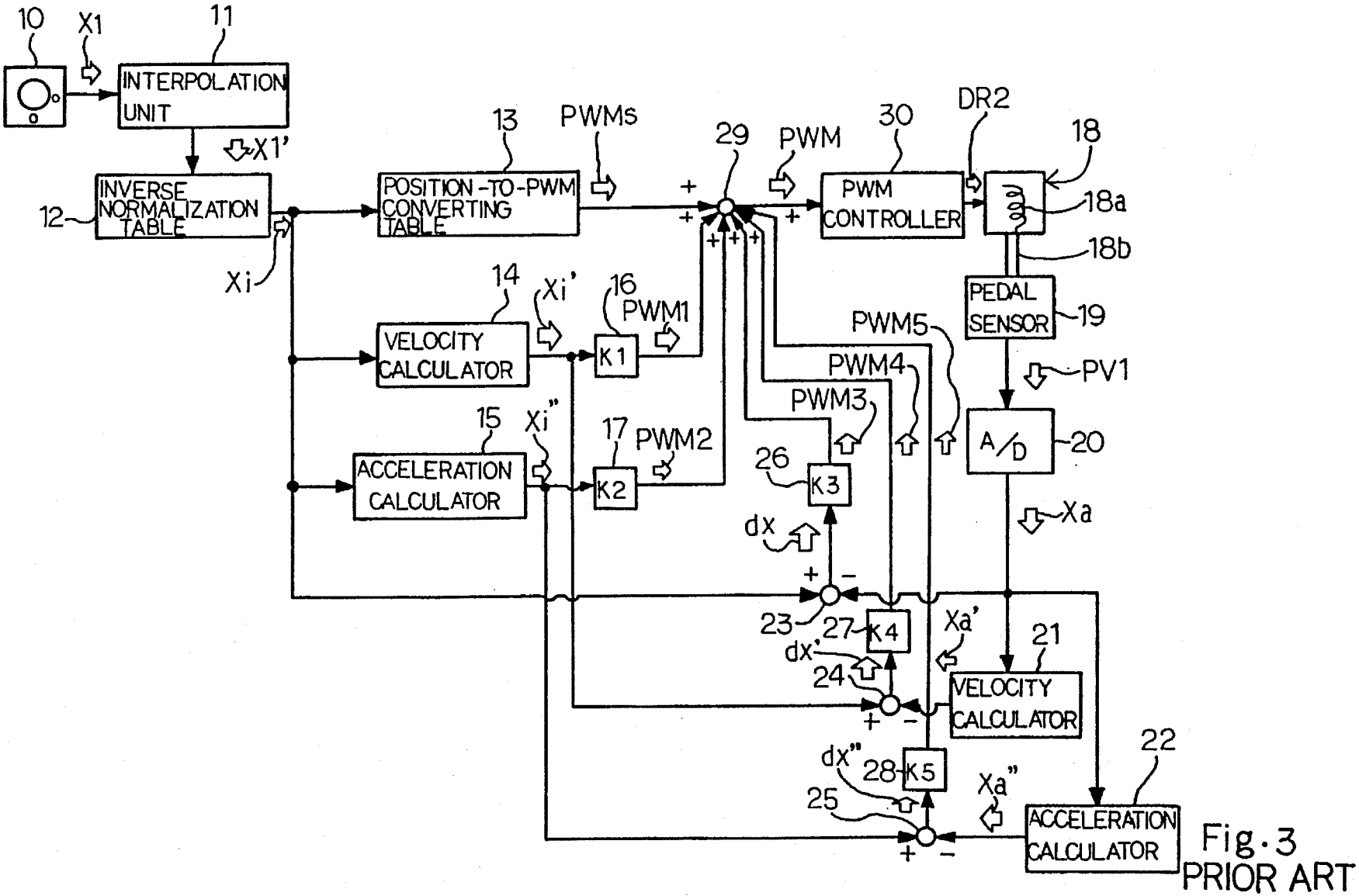
Fig. 3 PRIOR ART
FIG. 3 is a block diagram showing the arrangement of the prior art pedal controlling system.
Figure 4:
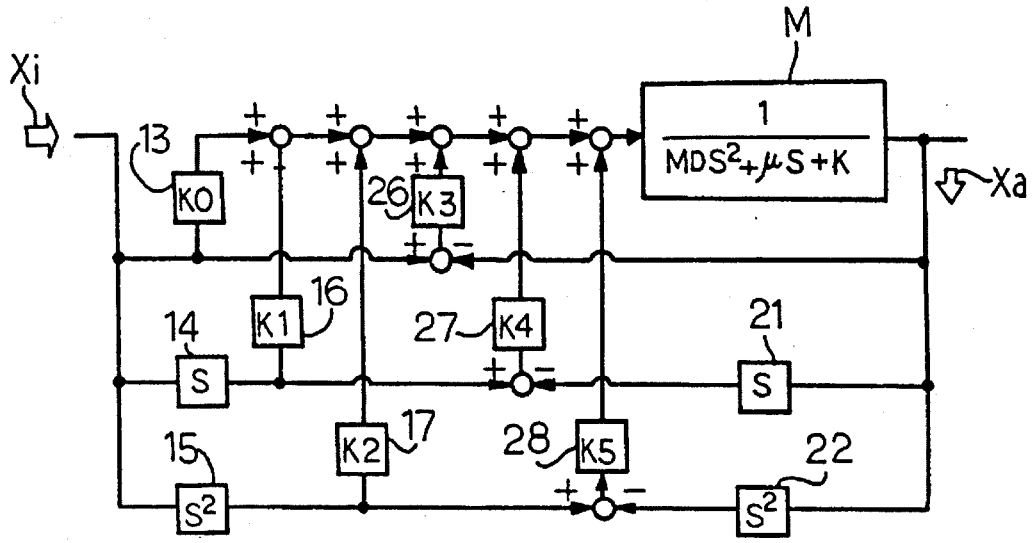
Fig. 4 PRIOR ART
FIGS. 4 to 11 are diagrams showing a process of determining the transfer function for the prior art pedal controlling system.
Figure 5:
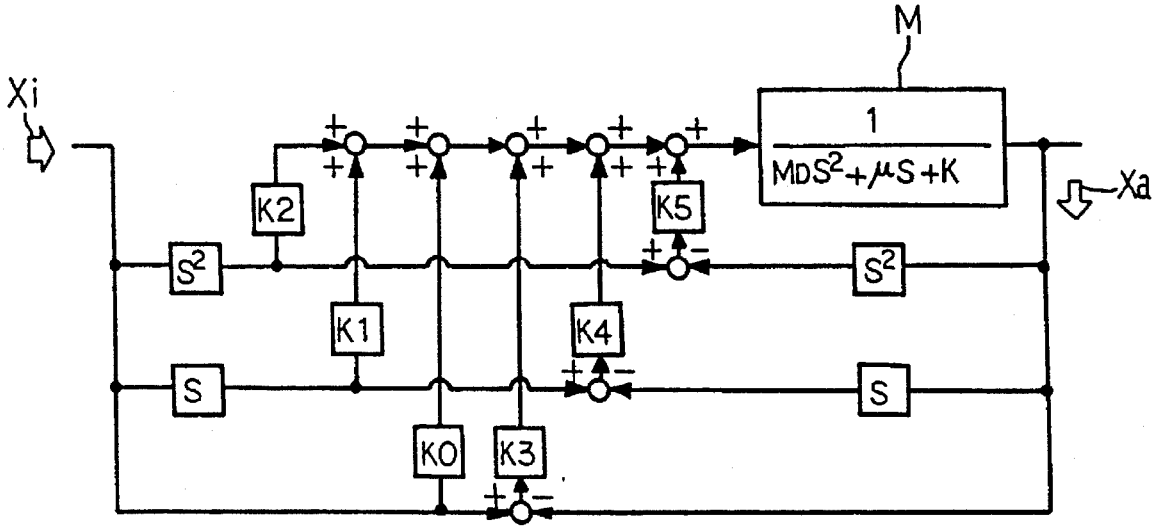
Fig. 5 PRIOR ART
Figure 6:
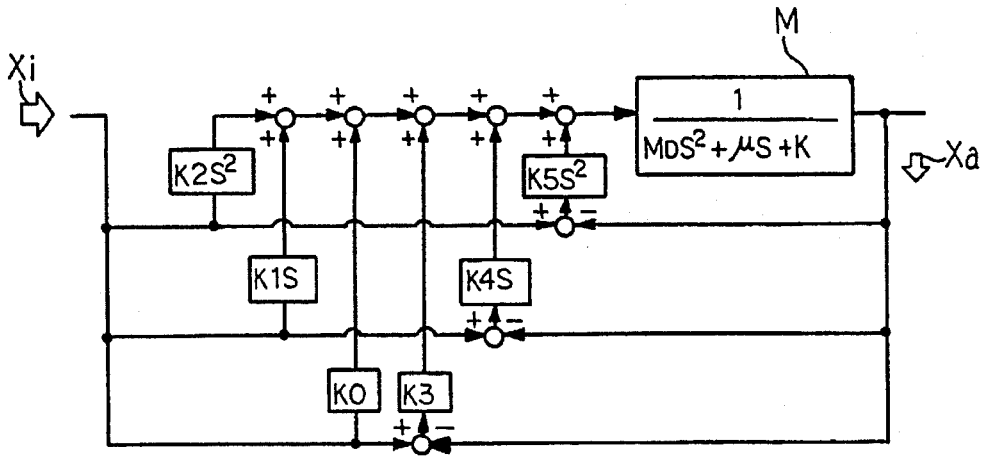
Fig. 6 PRIOR ART
Figure 7:
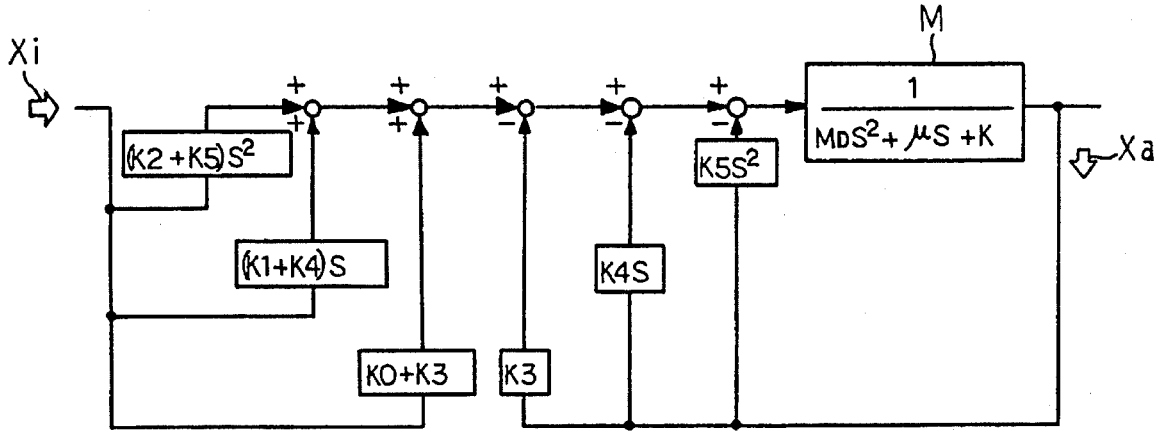
Fig. 7 PRIOR ART
Figure 8:
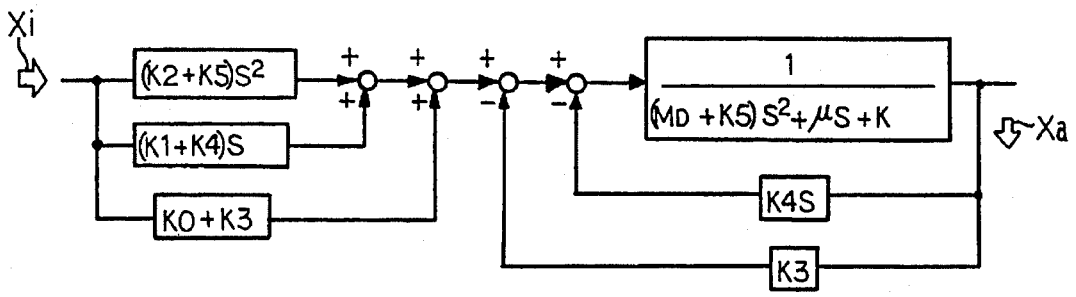
Fig·8 PRIOR ART
Figure 9:
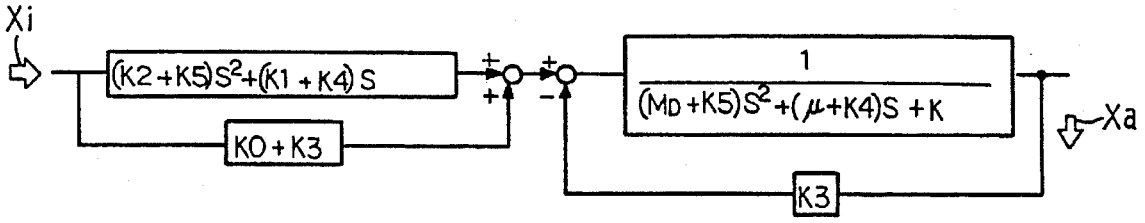
Fig·9 PRIOR ART
Figure 10:
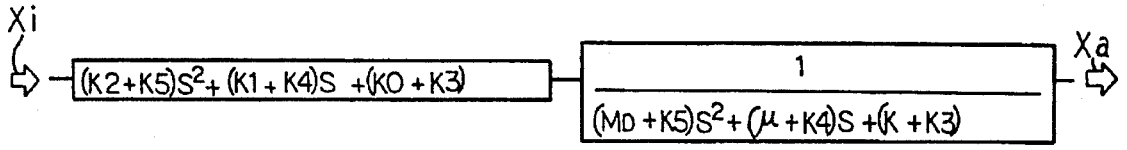
Fig·10 PRIOR ART
Figure 11:
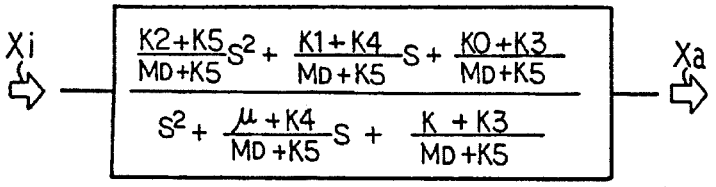
Fig·11 PRIOR ART
Figure 12:
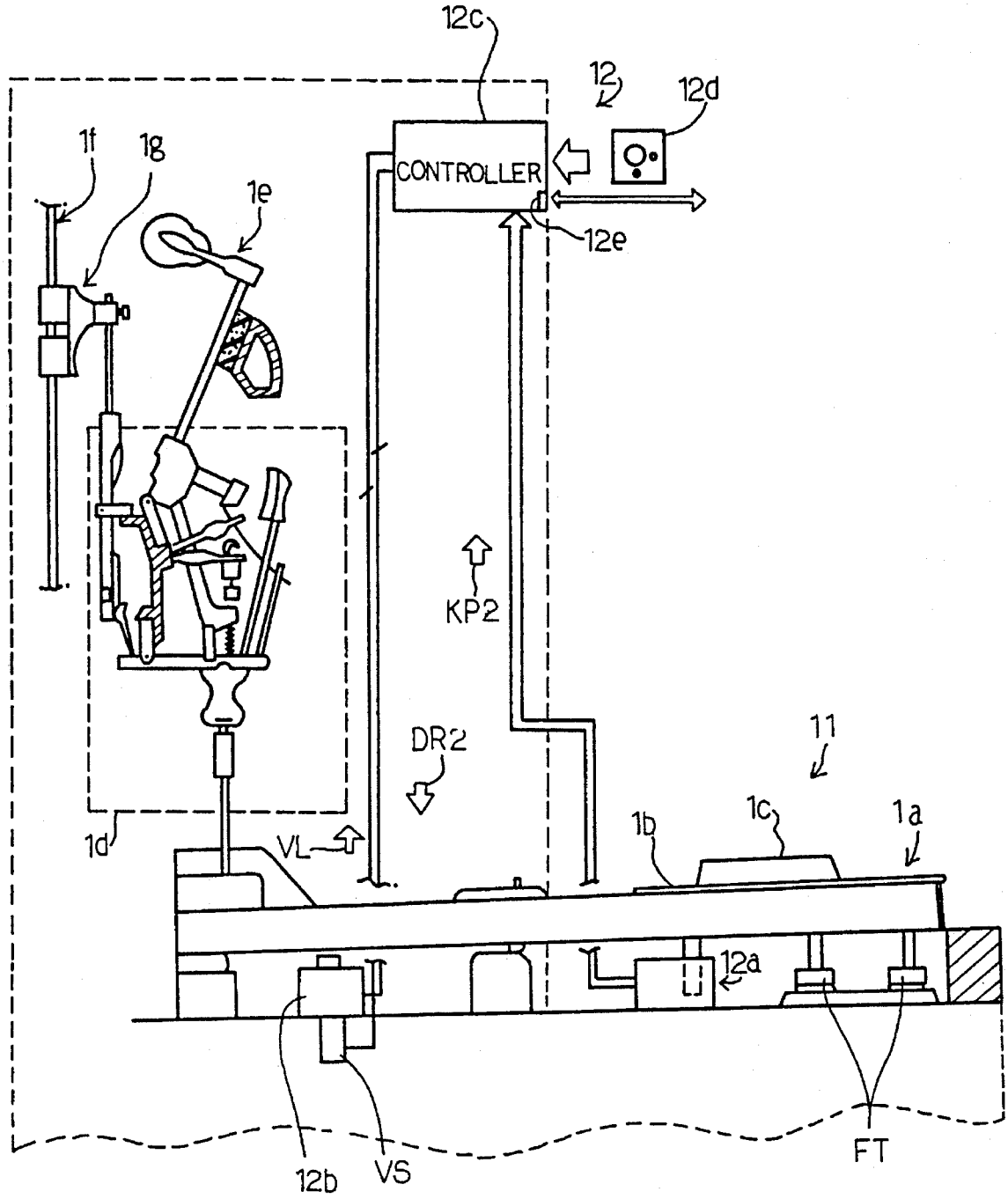
FIG. 12 is a partially cut-away side view showing the structure of an automatic player piano according to the present invention.

Referring to FIG. 12 of the drawings, an automatic player piano embodying the present invention largely comprises an upright piano 11 and an automatic playing system 12. The upright piano 11 is similar to the acoustic piano shown in FIG. 1, and the component members and mechanisms of the upright piano 11 are labeled with the same references as those of the acoustic piano 1 without detailed description.

The automatic playing system 12 comprises a plurality of key sensors 12*a* respectively associated with the black and white keys 1*b* and 1*c* for generating key position signals KP2, a plurality of solenoid-operated actuator units 12*b* responsive to driving signals DR2 for rotating the black and white keys 1*b* and 1*c* instead of a player, a plurality of velocity sensors VS associated with the plungers of the solenoid-operated actuator units 12*b*. The key sensors 12*a* monitors the associated black and white keys 1*b* and 1*c* for reporting current key positions through the key position signals KP2. The velocity sensors VS monitors the plungers of the associated solenoid-operated actuator units 12*b*, and each of the velocity sensors VS generates a plunger velocity signal VL indicative of an actual velocity of the plunger and, accordingly, an actual key velocity.

The controller 12*c* selectively enters a recording mode and a playback mode. In the recording mode, the player performs a music on the keyboard 1*a*, and the controller periodically fetches the key position signals 12*a* for generates a series of music data codes indicative of the performance. The controller 12*c* determines a depressed/released key, and calculates a key velocity on the basis of the variation of the actual key position. Therefore, each of the music data codes contains at least a first piece of data information indicative of a depressed/released key and a second piece of data information indicative of a key velocity, and the depressed/released key and the key velocity may be corresponding to a note-on/note-off message including a key velocity of the MIDI (Musical Instrument Digital Interface) codes. The series of music data codes may be stored in a floppy disk and/or delivered through a MIDI port 12*e*.

On the other hand, if the controller enters into the playback mode, a series of music data codes is supplied from the floppy disk 12*d* or the signal port 12*e* to the controller 12*c*, and the controller 12*c* selectively energizes the solenoid-operated actuator units 12*b* with the driving signals DR2 for reproducing the music.

Figure 13:
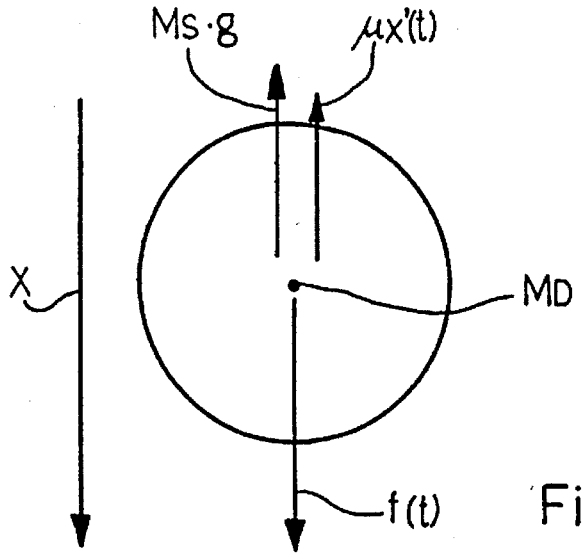
FIG. 13 is a view showing a model of the key incorporated in the automatic player piano.

The controlling sequence achieved by the controller 12*c* is so important that description is hereinbelow focused thereon. First, the motion of a key incorporated in a piano is analyzed as follows. FIG. 13 illustrates the physical model of key incorporated in a standard acoustic piano, and arrow X is indicative of a position vector when the key is moved. The inertial mass of the key is represented by $M_D$, and Ms is indicative of the static weight of the key. The gravitational acceleration, the viscosity resistance and the displacement of the key are respectively represented by "g", "mu" and x(t).

While a thrust f(t) is being exerted on the key, Ms×g and mu×(x'(t)) are exerted on the key in the opposite direction. Therefore, the following equation of motion is established.

$$M_D x''(t)=f(t)-mu\ x''(t)-Ms\ g \qquad \text{Equation 1}$$

The Laplace transform of Equation 1 is given as follows.

$$\zeta[M_D x''(t)]=\zeta[f(t)-mu\ x''(t)-Ms\ g] \qquad \text{Equation 2}$$

Equation 2 is modified as follows.

$$M_D(S^2X(s)-sx(0^+)-x'(0^+))=F(s)-mu(SX(s)-x(0^+))-Ms\ g \qquad \text{Equation 2'}$$

The initial values of $x(0^+)$ and $x'(0^+)$ are assumed to be zero, Equation 2' is changed as follows.

$$M_D S^2X(s)=F(s)-mu\ SX(s)-Ms\ g \qquad \text{Equation 3}$$

A transposition of term for Equation 3 results in Equation 3'.

$$(M_D S^2+mu\ S)X(s)=F(s)-Ms\ g \qquad \text{Equation 3'}$$

The input is (F(s)–Ms g), and the output is X(s). Then, the transfer function is given as follows.

$$\frac{X(s)}{F(s)-Ms\ g}=\frac{1}{M_D S^2+mu\ S}= \qquad \text{Equation 4}$$

$$\frac{\frac{1}{MD}}{S^2+\frac{mu}{M_D}S}=\frac{\frac{1}{MD}}{S\left(S+\frac{mu}{M_D}\right)}$$

Figure 14:
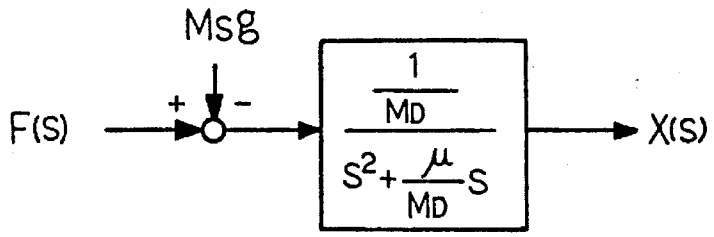
FIG. 14 is a block diagram showing a transfer function for the model of the key.

The input and the output of the transfer function are a force and a displacement, and the transfer function is illustrated in FIG. 14. However, in accordance with the present invention the music data code supplies the key velocity information to the controller 12*c*, and an actual key velocity is fed back to the system. For this reason, Equation 4 is multiplied by the differential element "S", and we obtain Equation 5.

$$G(s)=\frac{\frac{1}{M_D}}{S^2+\frac{mu}{M_D}S}S=\frac{\frac{1}{M_D}}{S+\frac{mu}{M_D}} \qquad \text{Equation 5}$$

Figure 15A:
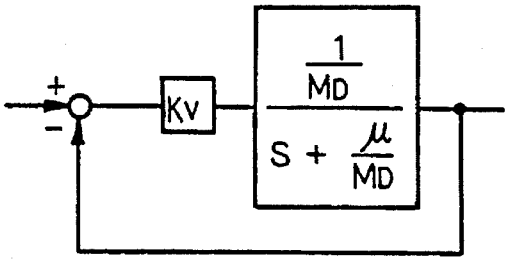
FIG. 15A is a block diagram showing a feed-back control model for the automatic playing system.
Figure 15B:
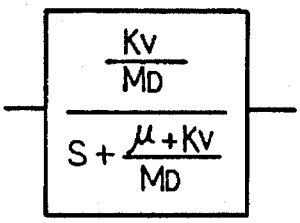
FIG. 15B is a view showing a closed-loop transfer function for the feed-back control model.

Equation 5 teaches that a first order lag takes place in the controlling system presently discussed, and the controlling system achieves a feed-back control with a servo-gain Kv as shown in FIG. 15A. The closed-loop transfer function of the feed-back control is shown in FIG. 15B.

Figure 16A:
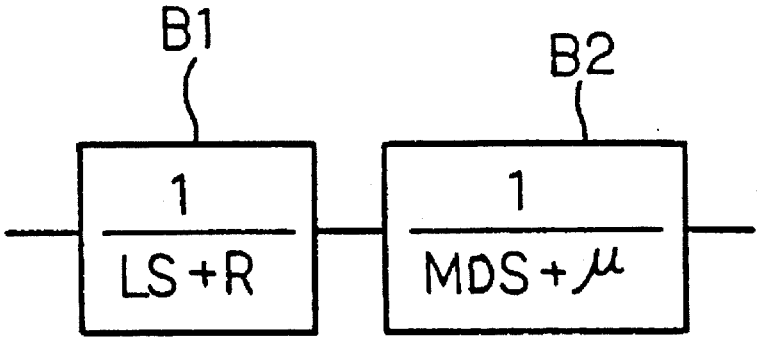
FIGS. 16A and 16B are views showing a process of calculating a transfer function of both solenoid and feed-back control mode.
Figure 16B:
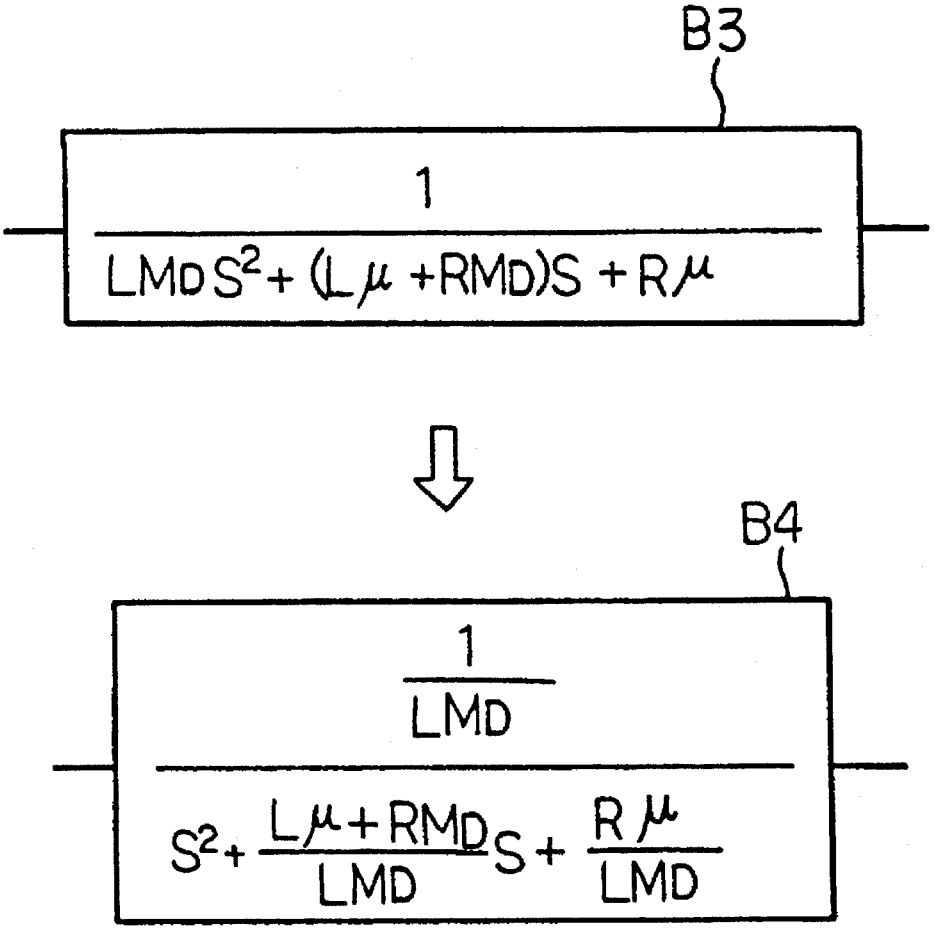

If an automatic playing system is the first-order lag system, the phase rotation never exceeds 90 degrees regardless of a frequency band, and, accordingly, the automatic playing system 2 is stable at all times. In this situation, it is possible to assume the feed-back gain to be infinity, and the steady velocity deviation is assumed to be zero. However, the automatic playing system contains various delay elements. For example, the solenoid coil of the solenoid-operated actuator unit 12*b* is one of the delay elements, and the control system is rewritable as shown in FIG. 16A. B1 and B2 are respectively indicative of the transfer function of the solenoid and the transfer function of the feed-back control . The inductance and the resistance against direct current are represented by "L" and "R" in the transfer function for the solenoid. The two transfer functions B1 and B2 compose a transfer function B3, and the transfer function is rearranged into a transfer function B4 as shown in FIG. 16B. Thus, the delay of the solenoid coil changes the controlling system to a second-order lag system, and the phase is possibly rotated at 180 degrees. This means that the system has a possibility to start oscillation. In general, an actual key to be controlled forms a part of high-order lag system, and it is not appropriate to assume the controlling system to be the simple first-order lag system, and, on the other hand, it is not feasible to take all of the lag elements into account. For this reason, the automatic playing system 2 is assumed to be an approximation of the high-order lag system, and major lag element or elements are taken into account as important parameters. The inductance of the solenoid and the delay time of the associated circuit are examples of the major lag elements and, accordingly, the important parameters. Then, Equation 6 is established.

$$G(s)=\frac{K\ wn^2}{S^2+2xi\ wn\ S+wn^2} \qquad \text{Equation 6}$$

where wn is an intrinsic angular frequency and xi is a damping factor. Relation between the terms of Equation 6 and the physical model shown in FIG. 13 is as follows.

$$2xi\ wn=\frac{L\ mu+RM_D}{LM_D} \qquad \text{Equation 7A}$$

$$wn^2=\frac{R\ mu}{L\ M_D} \qquad \text{Equation 7B}$$

$$K=\frac{1}{R\ mu} \qquad \text{Equation 7C}$$

Therefore, the intrinsic angular frequency wn and the damping factor xi are expressed as $$wn=\sqrt{\frac{R\ mu}{L\ M_D}} \qquad \text{Equation 8A}$$

$$xi=\frac{1}{2}\left[\sqrt{\frac{mu\ L}{M_D R}}+\sqrt{\frac{M_D\ R}{mu\ L}}\right] \qquad \text{Equation 8B}$$

Figure 17:
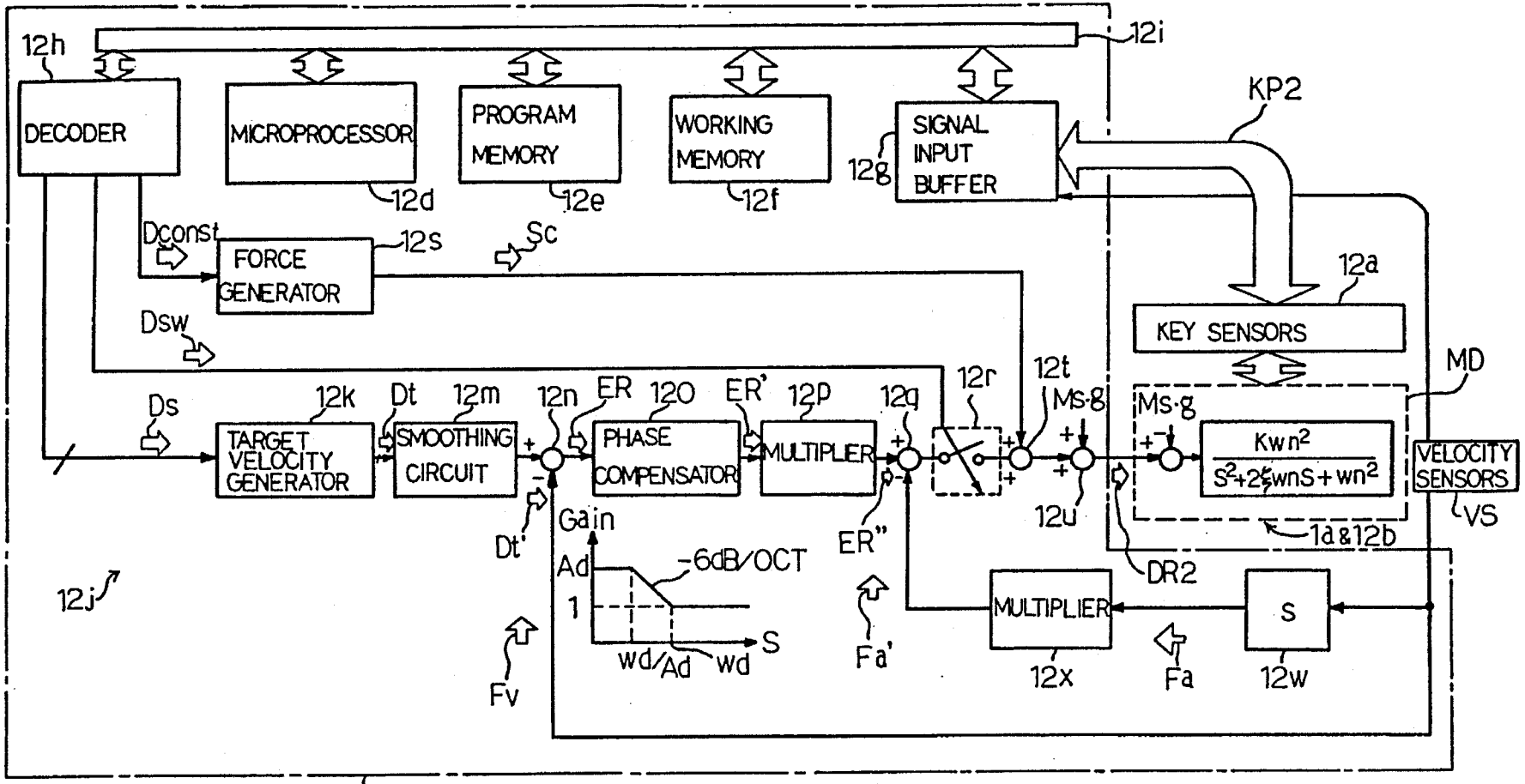
FIG. 17 is a block diagram showing a controller incorporated in the automatic player piano according to the present invention.

As will be understood from Equation 8B, xi is affected by the viscosity resistance mu and the inertial weight $M_D$, and the resistance against direct current R and the inductance L can not be ignoreable. If the automatic playing system 12 is assumed to be the first-order lag system, these lag elements destroy the stability of the system. For this reason, the automatic playing system 12 of the present embodiment is assumed to be a second-order lag system, and an acceleration is used for a feed-back loop. Turning to FIG. 17 of the drawings, the controller 12*c* comprises a microprocessor 12*d*, a program memory 12*e* for storing instruction codes, a working memory 12*f* for serving as a temporary data storage, a signal input buffer 12*g* connected to the key sensors 12*a*, a decoder 12*h* and a key velocity controlling subsystem 12*j*. The decoder 12*h* sequentially decodes output data codes including the music data codes supplied from the microprocessor 12*d* in the playback mode, and generates a velocity control data code Ds, a switching signal Dsw and a maintenance data code Dconst through the decoding. The value of maintenance data code is varied in accordance with a function, and causes each solenoid-operated actuator unit 12b to produce a constant force. The velocity control code Ds is representative of a key velocity equivalent to the key velocity contained in the MIDI code, and the decoder 12h supplies the switching signal Dsw and the maintenance data code Dconst at a timing equivalent to a returning timing of a depressed key 1b/1c in the original performance to the velocity controlling sub-system 12j. The returning timing is a time when the key 1b/1c reaches the lowest point of the trajectory from the rest position toward the end position. If the player depresses a key to the end position, the returning point is matched with the end position. The microprocessor 12d calculates a returning timing for the returning point on the basis of the plunger velocity signal VL supplied from the velocity sensor VS. When the key 1b/1c reaches the returning point, the microprocessor 12d supplies an output code to the decoder 12h so as to generates the switching signal Dsw and the maintenance data code Dconst.

The velocity controlling sub-system 12j comprises a target velocity generator 12k, 1 smoothing circuit 12m, an adder 12n, a phase compensator 12o, an adder 12q, a switching unit 12r, a force generator 12s, adders 12t and 12u, a differentiator 12w and a multiplier 12x. The velocity sensors VS and the differentiator 12w may be replaced with acceleration sensors, and semiconductor acceleration sensors may be attached to the plungers of the solenoid-operated actuator units 12b. These components circuits 12k to 12x achieve the following tasks in the playback mode.

The velocity control data code Ds is supplied to the target velocity generator 12k, and the target velocity generator 12k generates a target velocity signal Dt indicative of a target key velocity expected to reproduce the tone generated in the original performance. The target velocity signal Dt is supplied to the smoothing circuit 12m, and the smoothing circuit 12m is implemented by a low-pass filter with a transfer function expressed as follows.

$$\frac{wc^2}{S^2+\sqrt{3}\ wc\,S+wc^2} \qquad \text{Equation 9}$$

Figure 18:
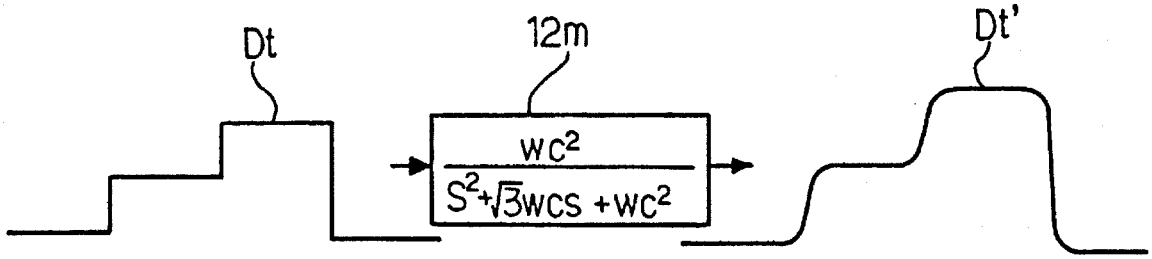
FIG. 18 is a view showing a function of a smoothing circuit incorporated in the controller.

The smoothing circuit 12m smoothens the target velocity code signal discretely changed as shown in FIG. 18, and prevents the velocity controlling sub-system 12j from unstable behavior. The smoothing circuit 12m outputs a target velocity signal Dt', and the target velocity signal Dt' is supplied to the adder 12n. The smoothing circuit 12m is expected to minimize a distortion of the waveform, and it is desirable for the smoothing circuit 12m to be constant in the group delay time. The smoothing circuit 12m may be implemented by a calculator for averaging the discrete values or an interpolation circuit.

Figure 19:
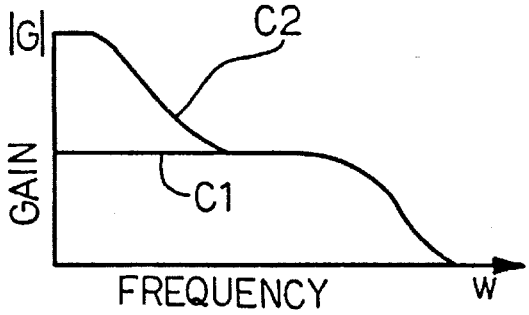
FIG. 19 is a graph showing a function of a phase compensator incorporated in the controller.

The adder 12n subtracts the value of a feed-back signal Fv from the value of the target velocity signal Dt', and produces a velocity error signal ER. The velocity error signal ER is supplied to the phase compensator 12o, and increases a gain of the low-frequency component of the velocity error signal ER. The phase compensator 12o has the following transfer function $$\frac{S+wd}{S+\frac{wd}{Ad}} \qquad \text{Equation 10}$$

where Ad is indicative of the gain from the direct current component to the low-frequency range. The gain is decreased for a frequency band between wd/Ad to wd at −6 dB/oct. If frequency characteristics of the system is represented by Plots C1 of FIG. 19, the phase compensator 12o changes the frequency characteristics as indicated by Plots C2. Thus, the phase compensator 12o boosts the gain in the low frequency range. A large feed-back gain for a high frequency band is causative of an oscillation due to the second-order lag possibly exceeding 180 degrees, but a large gain for a low frequency band does not oscillate the system, because only a small amount of frequency components in the low frequency band is fed back. The increase of the gain in the low frequency range decreases the steady-state velocity deviation component at the adder 12n.

The velocity error signal ER' treated by the phase compensator 12o is supplied to the multiplier 12p, and the multiplier multiplies the value of the velocity error signal ER' by a gain Kv. The velocity error signal ER" is supplied to the adder 12q, and the adder 12q subtracts the value of an acceleration signal Fa' from the value of the velocity error signal ER".

The switch unit 12r is responsive to the switching signal Dsw for transferring a level signal Sc to the adder 12t. The force generator 12s generates the level signal Sc from the maintenance data code Dconst, and the level signal Sc is indicative of a certain maintenance force expected to be produced by the solenoid-operated actuator unit 12b.

The adder 12t transfers one of the output of the adder 12q and the level signal Sc to the next adder 12u, and the adder 12u adds a value indicative of a static mass (Ms g) to the output of the adder 12q or the value of the level signal Sc. The static mass may include not only the mass of the key 1b/1c but also the mass of the plunger of the solenoid-operated actuator unit 12b. $M_D$ is indicative of the physical model of the key 1b/1c containing the solenoid of the actuator 12b, and is a second-order lag system. The transfer function of the physical model $M_D$ is expressed by Equation 6.

While the key 1b/1c is moving, the associated velocity sensor VS monitors the actual position of the key 1b/1c, and reports the current plunger velocity through the velocity signal VL to the signal input buffer 12g, the adder 12n and the differentiator 12w. The microprocessor 12d fetches the key position signal KP2, and calculates the returning time. The velocity signal VL is supplied to the adder 12n and the differentiator 12w as the feed-back signal Fv.

The differentiator 12w differentiates the value of the feed-back signal Fv for generating an acceleration signal Fa indicative of the acceleration of the key 1b/1c. The multiplier 12x multiplies the value of the acceleration signal Fa by an acceleration feed-back gain Ka for producing the acceleration signal Fa' and supplies the acceleration signal Fa' to the adder 12q.

In this instance, the adders 12q, the differentiator 12w and the multiplier 12x form parts of an acceleration feed-back loop together with the adder 12u, and the adder 12n, the phase compensator 12o and the multiplier 12p are members of a velocity feed-back loop.

While the controller 12c is reproducing a music in the playback mode, the microprocessor sequentially supplies the music data codes, and the decoder 12h produces the velocity control data code Ds from each of the music data codes. The velocity controlling sub-system supplies the velocity error signal ER" to the adder 12q until the returning point, and the solenoid of the actuator 12b generates electro-magnetic force corresponding to the output signal of the adder 12u. Then, the plunger of the actuator 12b projects so as to rotate the key 1b/1c at the velocity sequentially corrected by the feed-back signal Fv.

When the key 1b/1c reaches the returning point on the way from the rest position to the end position, the automatic playing system 12 behaves as follows.

Figure 20A:
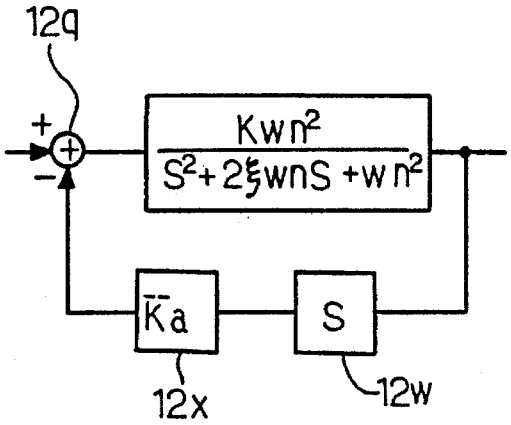
FIGS. 20A to 20C are block diagrams showing an acceleration feed-back loop incorporated in the controller.
Figure 20B:
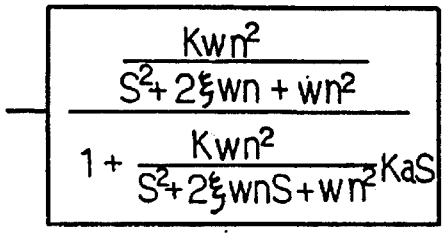
Figure 20C:
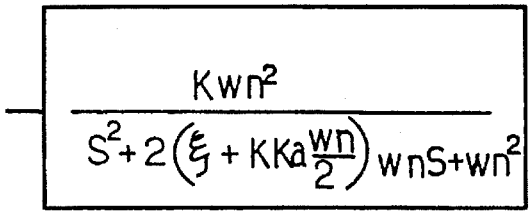

First, we examines the acceleration feed-back loop and the velocity feed-back loop. FIG. 20A illustrates the acceleration feed-back loop, and the closed-loop transfer function of the acceleration feed-back loop is expressed as shown in FIG. 20B. The transfer function shown in FIG. 20B is changed to the transfer function shown in FIG. 20C. Therefore, the acceleration feed-back loop has the following transfer characteristics.

$$\frac{K\,wn^2}{S^2+2\left[xi+K\,Ka\frac{wn}{2}\right]wn\,S+wn^2} \qquad \text{Equation 11}$$

Comparing the transfer function expressed by Equation 11 with the transfer function of the physical model expressed as Equation 6, the damping factor xi is changed to (xi+k Ka wn/2), and the other terms are unchanged. The damping factor xi enhances the stability of the automatic playing system 12, and the modification of the damping factor (xi+K Ka wn/2) is regulable by changing the gain Ka of the multiplier 12*x*. This means that the regulation of the gain of the multiplier 12*x* results in the stability of the automatic playing system 12.

On the other hand, the velocity feed-back loop tries to decrease the deviation at the adder 12*n* to zero, and the target key velocity is adjustable to an arbitrary value. If the gain Kv of the multiplier 12*p* has a large value, the velocity feed-back loop is promptly responsive to the velocity feedback signal Fv, and decreases the steady-state deviation. The physical model takes the second-order or higher-order lag into account, and there is a limit to the gain Kv of the multiplier 12*p*. However, the acceleration feed-back loop allows the manufacturer to regulate the damping factor xi, and the enhanced stability of the system 12 in turn allows the manufacturer to give a large gain to the multiplier 12*p*.

The phase compensator 12*o* increases the gain for the low frequency range containing the direct current component, and a large gain is provided for the steady-state deviation, because the steady-state deviation contains much direct current component. Thus, the velocity feed-back loop achieves a velocity feed-back control under a minimized steady-state deviation.

Figure 21:
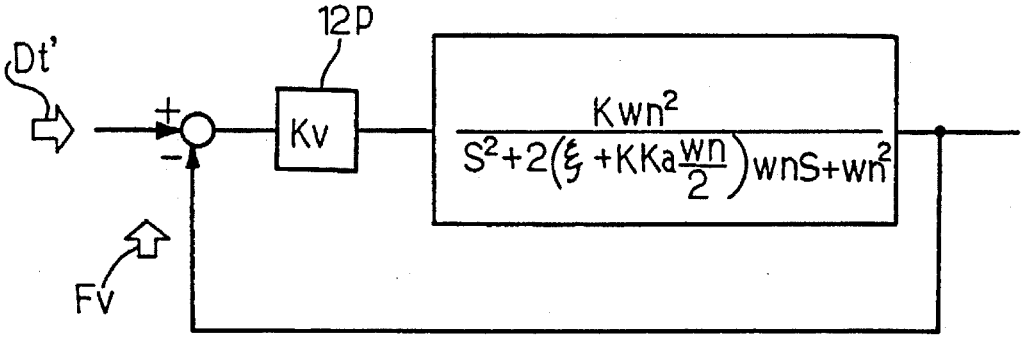
FIG. 21 is a block diagram showing a composite feedback loop for the acceleration feed-back control and a velocity feed-back control.

FIG. 21 illustrates a composite feed-back loop for the acceleration feed-back control and the velocity feed-back control of the automatic playing system 12. The transfer function G(s) of the composite feed-back loop is expressed as $$G(s) = \frac{Kv\dfrac{K\,wn^2}{S2+2[xi+K\,Ka\,(wn/2)]wn\,S+wn^2}}{1+Kv\dfrac{K\,wn^2}{S^2+2[xi+K\,Ka\,(wn/2)]wn\,S+wn^2}} = \frac{Kv\,K\,wn^2}{S^2+2[xi+K\,Ka\,(wn/2)]\,wn\,S+wn^2+Kv\,K\,wn^2} \qquad \text{Equation 12}$$

Comparing Equation 12 with Equation 6, $wn^2$ is changed to (1+K Kv) $wn^2$, and it is understood that the apparent intrinsic angular frequency wn is regulable by changing the gain Kv of the multiplier 12*p*. Since the angular frequency wn is close to the resonance frequency of the loop, and the manufacturer further regulates the resonance frequency by changing the gain Kv.

As described hereinbefore, while the plunger of the solenoid-operated actuator unit 12*b* is pushing up rear end portion of the associated key 1*b*/1*c*, the front end position of the key 1*b*/1*c* is reaching the returning point, and is finally brought into contact with a felt member FT. The felt member FT serves as a spring, and the physical model tends to fall into oscillation. Even if the key 1*b*/1*c* is brought into contact with the felt member FT at 1 m/s, the key velocity is suddenly decreased to zero. The velocity feed-back loop is active, and the phase compensator 12*o* increases the gain for the low frequency range. This results in that the amount of driving current to the solenoid coil is suddenly increased, and the velocity feed-back loop is liable to oscillate.

Figure 22:
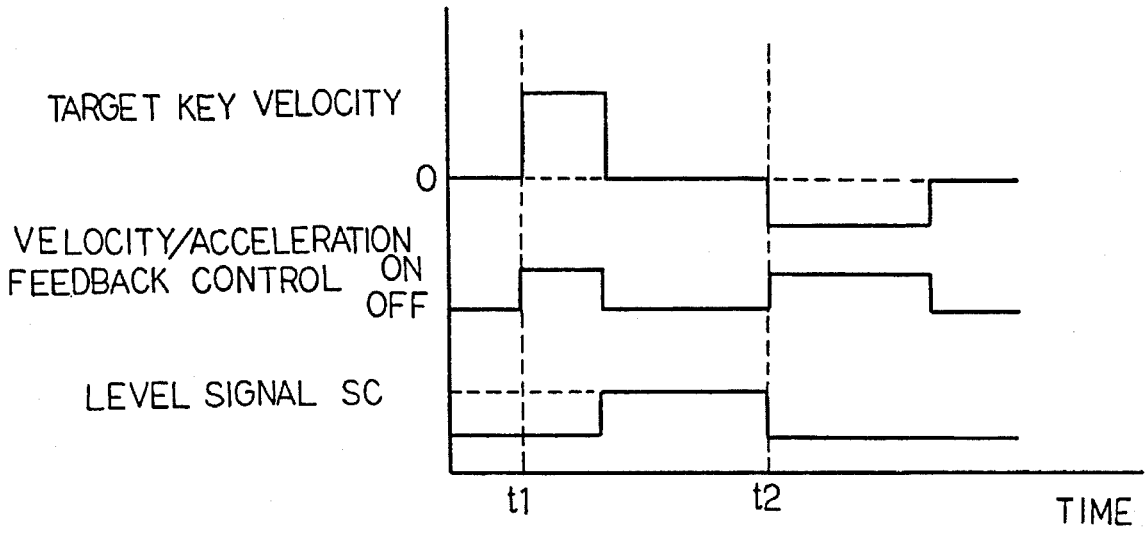
FIG. 22 is a timing chart showing a release from the velocity/acceleration feed-back control.

In order to prevent the velocity feed-back loop from the oscillation, the microprocessor 12*d* instructs the decoder 12*h* to supply the switching signal Dsw and the maintenance data code Dconst to the switch unit 12*r* and the force generator 12*s*, and the switch unit 12*r* releases the physical model $M_D$ from the velocity/acceleration feed-back control at time t1 of FIG. 22. The switch unit 12*r* supplies the level signal SC from the force generator 12*s* to the adder 12*u*, and the level signal SC causes the solenoid-operated actuator unit 12*b* to generate a constant force. This results in that the velocity feed-back loop is prevented from the oscillation. The depressed key 1*b*/1*c* is maintained at the returning point, which is usually the end position of the key, under the constant force.

If the key 1*b*/1*c* escapes from the returning point at time t2, the automatic playing system 12 returns to the velocity/acceleration feed-back control, and the key 1*b*/1*c* returns toward the rest position. The microprocessor instructs the decoder 12*h* to change the switch unit 12*r* with the switching signal Dsw, and the automatic playing system 12 restarts the velocity/acceleration feed-back control.

In the original performance, when the key 1*b*/1*c* reaches the returning point, which is usually the end position, the player holds the depressed key 1*b*/1*c* at the returning point for a moment, and the controller 12*c* according to the present invention faithfully controls the motion of the depressed key 1*b*/1*c* in the playback mode. However, if a depressed key 1*b*/1*c* is expected to quickly return to the rest position in, for example, a shallow fingering, the controller 12*c* does not produce the maintenance data code Dconst and the switching signal Dsw.

In this instance, the key sensors 12*a*, the velocity sensors VS serve as a plurality of monitoring means, and the floppy disk 12*d* or the data port 12*e*, the microprocessor 12*d*, a program sequence for generating the data codes, the decoder 12*h*, the target velocity generator 12*k* and the smoothing circuit 12*m* form in combination a target key velocity supplying means. The microprocessor 12*d*, the decoder 12*h*, the force generator 12*s* and the switch unit 12*r* as a whole constitute an oscillation prohibiting means.

As will be appreciated from the foregoing description, the acceleration feed-back loop enhances the stability of the automatic playing system 12, and the velocity feed-back loop controls the velocity error signal ER in such a manner as to decrease the steady-state deviation to zero. As a result, the automatic playing piano embodying the present invention is free from the problems inherent in the prior arts. Namely, the increase of the resistance due to the heat generation and the aged deterioration of, for example, the key action mechanisms 1*d* are canceled by the velocity feed-back loop without sacrifice of the stability of the system, and the dispersion of the characteristics of the key action mechanisms 1*d* is regulable by changing the gain in the feed-back loop.

In the embodiment described hereinbefore, the level signal SC is supplied to the adder 12*t* at the returning point. However, a modification may decrease the gains Kv and Ka so as to maintain the key 1*b*/1*c* with a constant force. Moreover, another modification may release the automatic playing system 12 from the velocity/acceleration feed-back control before reaching the returning point. The releasing point may be directly detected by a sensor or calculated by using a key velocity.

The key velocity may be directly detected by a velocity sensor provided for each key 1*b*/1*c*, and the acceleration may be directly detected by using an acceleration sensor each provided for the key 1*b*/1*c*.

Figure 23:
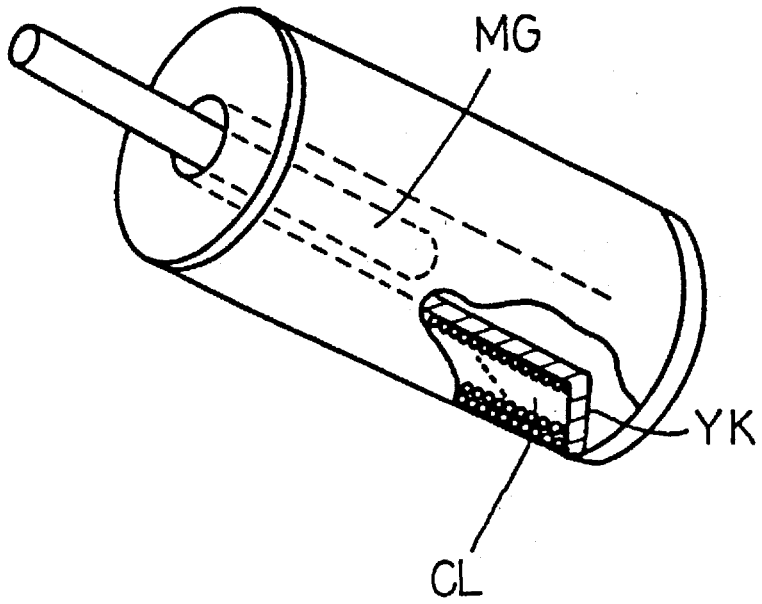
FIG. 23 is a partially cut-away perspective view showing a velocity sensor incorporated in the velocity feed-back controlling sub-system.
Figure 24:
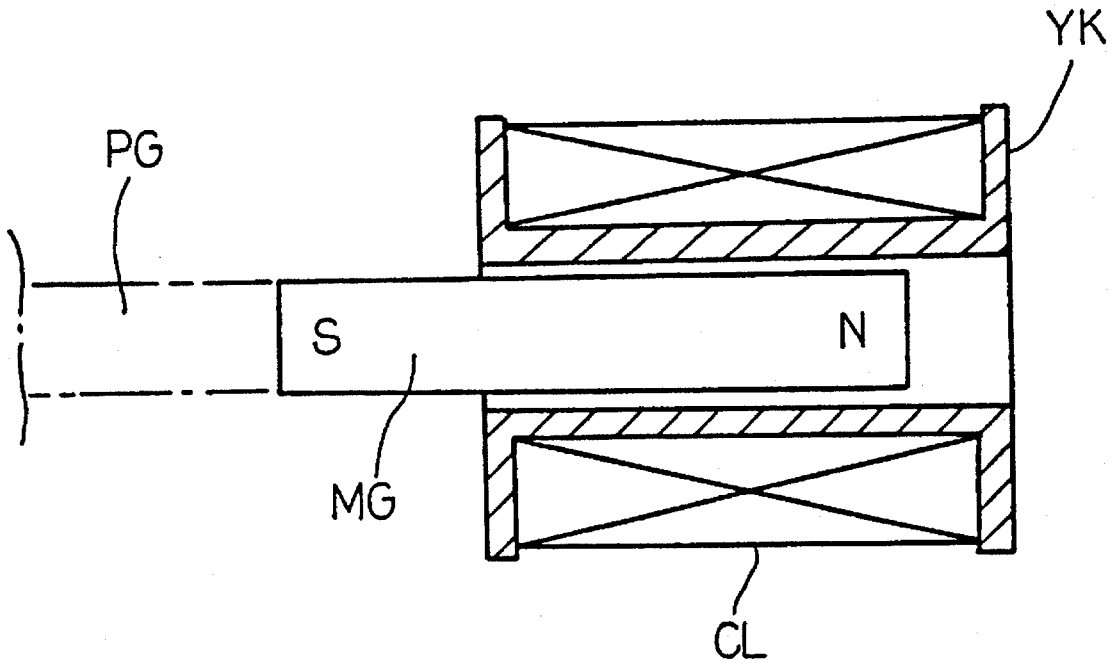
FIG. 24 is a cross sectional view showing the structure of the velocity sensor incorporated in the velocity feed-back controlling sub-system.

Each of the velocity sensors VS is implemented by a coil member CL wound on a yoke member YK and a permanent magnetic piece MG attached to the associated plunger PG as shown in FIGS. 23 and 24.

Although particular embodiments of the present invention have been shown and described, it will be obvious to those skilled in the art that various changes and modifications may be made without departing from the spirit and scope of the present invention. For example, the automatic playing system according to the present invention may be incorporated in an acoustic piano equipped with a hammer shank stopper. One of the acoustic pianos equipped with the hammer stopper is disclosed in U.S. Ser. No. 08/073,092.

What is claimed is:

1. A keyboard musical instrument comprising:

an acoustic piano having a keyboard implemented by a plurality of keys selectively rotated by a player, a plurality of sets of strings respectively assigned notes of a scale identical with said plurality of keys, a plurality of hammer assemblies respectively associated with said plurality of sets of strings and rotated for striking the associated sets of strings, and a plurality of key action mechanisms functionally connected to said plurality of keys, respectively, and rotating said hammer assemblies when the associated keys are rotated; and an automatic playing system having a plurality of actuator units respectively associated with said plurality of keys, and selectively rotating the associated keys in the presence of driving signals, a plurality of monitoring means respectively associated with said plurality of keys, and determining actual key velocities of the associated keys when the associated keys are rotated, a target key velocity supplying means outputting target key velocities for keys selected from said plurality of keys to be rotated, a velocity feedback loop functionally connected to said target key velocity supplying means and said plurality of monitoring means and operative to respectively compare said target key velocities with the actual key velocities of the keys for generating a plurality of velocity error signals, and an acceleration feedback loop functionally connected to said velocity feedback loop and said plurality of monitoring means and determining accelerations of the keys rotated by the associated actuator units, said acceleration feedback loop being operative to varies said velocity error signals with said accelerations for generating said driving signals.

2. The keyboard musical instrument as set forth in claim 1, in which said plurality of monitoring means determines returning points where said keys change the motions thereof from one directions to the opposite directions, said automatic playing system further comprising an oscillation prohibiting means operative to disable said velocity feedback loop and said acceleration feedback loop for determining the value of said driving signals in accordance with a function.

3. The keyboard musical instrument as set forth in claim 1, in which said returning point is an end point of each of said plurality of keys.

4. The keyboard musical instrument as set forth in claim 3, in which said function causes one of said plurality of actuator units to produce a constant force so that said each of said plurality of keys is held at said end position for a moment.

5. The keyboard musical instrument as set forth in claim 1, in which said plurality of actuator units are solenoid-operated actuator units, each of said actual key velocities containing a first variable component indicative of an increment of a resistance of the solenoid of each solenoid operated actuator unit against one of said driving signals and a second variable component indicative of an aged deterioration of the associated key action mechanism.

6. The keyboard musical instrument as set forth in claim 1, in which said target key velocity supplying means has a smoothing circuit operative to smoothly vary the values of each of said target key velocities.

7. The keyboard musical instrument as set forth in claim 1, in which said velocity feedback loop comprises an adder operative to add the value of each of said target key velocities to the value of the actual key velocity for producing first preliminary velocity error signal, a phase compensator supplied with said first preliminary velocity error signals and operative to increase a gain for a low frequency range of each of said first preliminary velocity error signals containing a direct current component, and a multiplier connected supplied with each of said first preliminary velocity error signals from said phase compensator and operative to multiply the value of said velocity error signal by a first gain for supplying said velocity error signal to said acceleration feedback loop.

8. The keyboard musical instrument as set forth in claim 1, in which said acceleration feedback loop comprises a differentiator supplies with said actual key velocities from said plurality of monitoring means for calculating preliminary accelerations, a multiplier operative to multiply the value of each of said preliminary accelerations by a gain for producing said accelerations, and a first adder operative to add the values of said velocity error signals to the values of said accelerations, respectively, for producing preliminary driving signals.

9. The keyboard musical instrument as set forth in claim 8, in which further comprising a second adder operative to add the value indicative of a static weight of each key to values of said preliminary driving signals for generating said driving signals.

* * * * *